US007086202B2

(12) United States Patent
Regier

(10) Patent No.: US 7,086,202 B2
(45) Date of Patent: Aug. 8, 2006

(54) MOUNTING DEVICE AND METHOD

(75) Inventor: John Regier, Culpepper, VA (US)

(73) Assignee: HNI Technologies Inc., Muscatine, IA (US)

( * ) Notice: Subject to any disclaimer, the term of this patent is extended or adjusted under 35 U.S.C. 154(b) by 360 days.

(21) Appl. No.: 10/646,626

(22) Filed: Aug. 22, 2003

(65) Prior Publication Data

US 2004/0103590 A1 Jun. 3, 2004

Related U.S. Application Data

(60) Provisional application No. 60/405,619, filed on Aug. 22, 2002.

(51) Int. Cl.
*F24B 1/198* (2006.01)

(52) U.S. Cl. ..... 52/36.3; 52/126.3; 52/745.1; 248/478

(58) Field of Classification Search ..... 52/36.3, 52/36.4, 38, 126.1, 126.3, 745.1; 248/475.1, 248/478, 495; 40/757
See application file for complete search history.

(56) References Cited

U.S. PATENT DOCUMENTS 2,943,831 A * 7/1960 Goss ..... 248/495
3,550,894 A * 12/1970 Louis ..... 248/316.4
3,930,491 A 1/1976 Miller
4,254,596 A 3/1981 Wright et al.
4,542,736 A 9/1985 Scheler
4,679,368 A * 7/1987 Pettinga et al. ..... 52/36.4
4,712,761 A * 12/1987 Wassell ..... 248/475.1
4,945,692 A 8/1990 Gallier
5,014,682 A 5/1991 Payson et al.
5,119,603 A * 6/1992 Jones ..... 52/36.3
5,375,802 A * 12/1994 Branham, II ..... 248/221.11
5,711,115 A 1/1998 Wirt
5,794,610 A 8/1998 Facchina
5,878,987 A * 3/1999 Hayde ..... 248/477
6,056,375 A 5/2000 Tidmore
6,138,968 A * 10/2000 Svantesson et al. ... 248/222.13
6,659,418 B1 * 12/2003 Lemire ..... 248/495
6,663,075 B1 * 12/2003 Zuller ..... 248/476
6,832,446 B1 * 12/2004 Lemire ..... 40/761

OTHER PUBLICATIONS

Heat-N-Glo, line gas products, *the Vantage*, product brochure.

* cited by examiner

*Primary Examiner*—Naoko Slack
(74) *Attorney, Agent, or Firm*—Faegre & Benson LLP

(57) ABSTRACT

A mounting assembly for mounting objects such as a fireplace mantel to a wall. The assembly includes a ledger strip for mounting on a wall and one or more mounting devices that are located on the mantel. Each mounting device includes a plunger slideably mounted within a main body and coupled to the mantel, and a compressible member cooperating with the plunger. The compressible member allows the mantel to be positioned on the wall when the mounting device is rested on the ledger strip. The compressible member allows the ledger strip to be quickly attached to the wall without highly-precise measurement, and the mantel to be accurately and securely positioned yet easily adjusted.

10 Claims, 7 Drawing Sheets

MOUNTING DEVICE AND METHOD

RELATED APPLICATION

This application claims the benefit of U.S. Patent Provisional Application Ser. No. 60/405,619, filed Aug. 22, 2002, which is incorporated by reference herein in its entirety.

FIELD OF THE INVENTION

This invention relates to mounting devices and, in particular, to assemblies and methods for mounting a fireplace mantel.

BACKGROUND

Many objects, such as mantels for fireplaces, are mounted on walls. Mantels (including what are typically described as surrounds) are used on fireplaces for both decorative and functional effects. For functional use, mantels typically are used for storage or displaying of objects. Mantels can also enhance the aesthetic appearance of a fireplace.

Installation of fireplace mantels can be a difficult task. One of the most difficult aspects of installation of a mantel is attachment of the mantel to a wall of a structure in a manner that does minimal damage to the appearance or function of the mantel and yet is suitably secured to the wall.

One common method of installing a mantel is to nail or screw the mantel to the wall in several locations, such as nailing diagonally down through the top into the wall, through various points on the legs, or by breaking off part of the dentil molding or other molding on face of mantel, nailing in the area of the molding footprint, and then re-gluing the molding to the mantel.

There are disadvantages associated with the typical installation methods. For example, the finished surface of the mantel can be easily damaged, even by one skilled in the art. Further, nailing or screwing through the finished surface of the mantel can leave holes in the finished surface that must preferably be disguised after attachment. In addition, it can be difficult to readjust the mantel position, if necessary, after installation. Further, it can also be difficult for one unskilled in the art to locate areas inside the wall that will securely hold nails and screws.

It would therefore be desirable to provide a mounting assembly that makes installation of an object such as a fireplace mantel less difficult than current systems and that can preferably be accomplished with a minimum of measurements by the installer.

SUMMARY OF THE INVENTION

This invention relates to mounting devices and, in particular, to assemblies and methods for mounting a fireplace mantel.

In one example, non-limiting embodiment, a mounting assembly can include a mounting device with a main body defining a space, a plunger disposed within the space and configured to move within the space, and a biasing member coupled to and biasing the plunger.

An object, such as a mantel for a fireplace, can be mounted to a wall of a structure using one or more of the mounting devices.

The above summary of the present invention is not intended to describe each disclosed embodiment or every implementation of the present invention. Figures in the detailed description that follow more particularly exemplify embodiments of the invention. While certain embodiments will be illustrated and described, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

Figure 1:
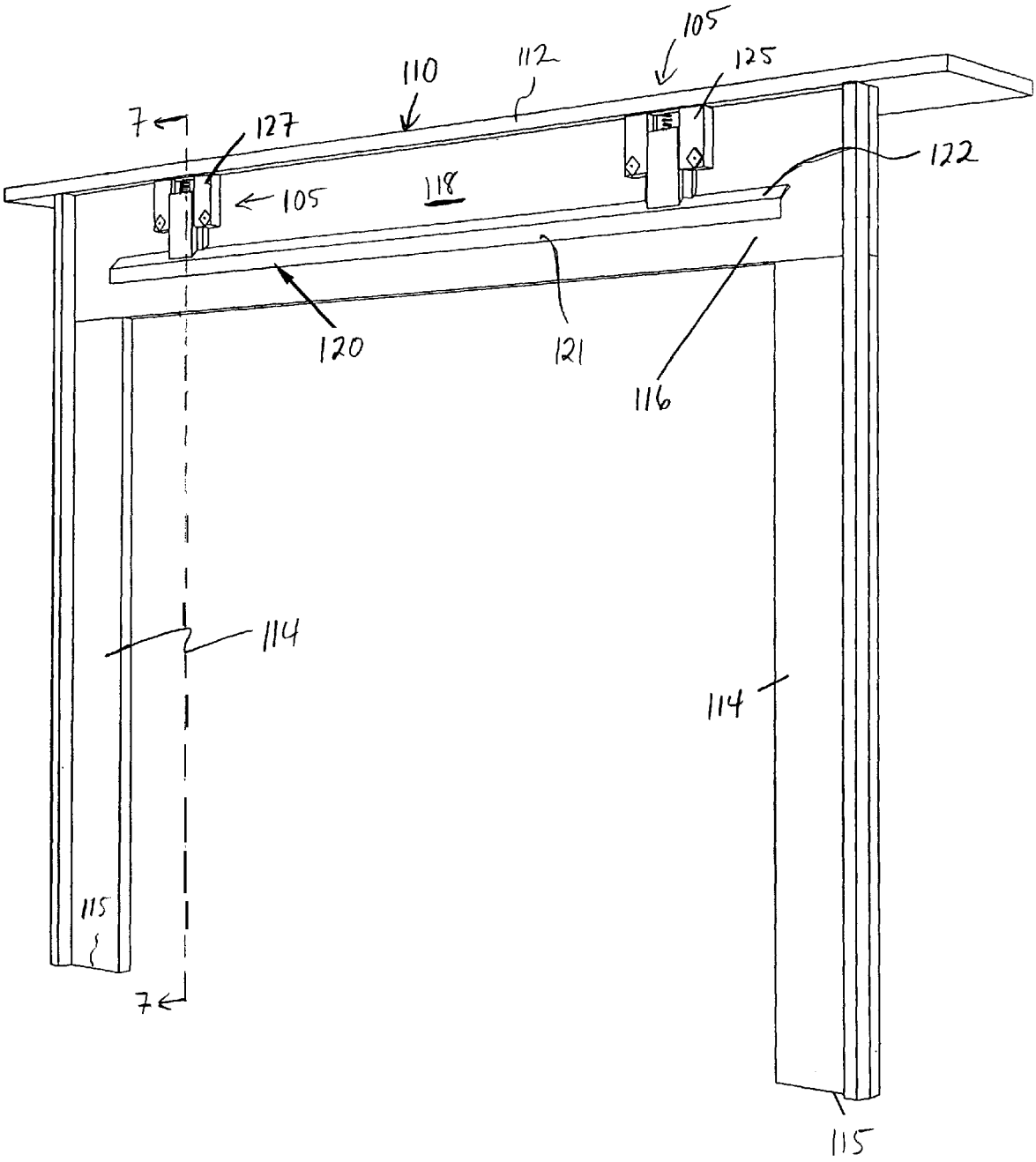
FIG. 1 is a back perspective view of a fireplace mantel incorporating an example embodiment of a mounting assembly, according to the present disclosure.
Figure 2:
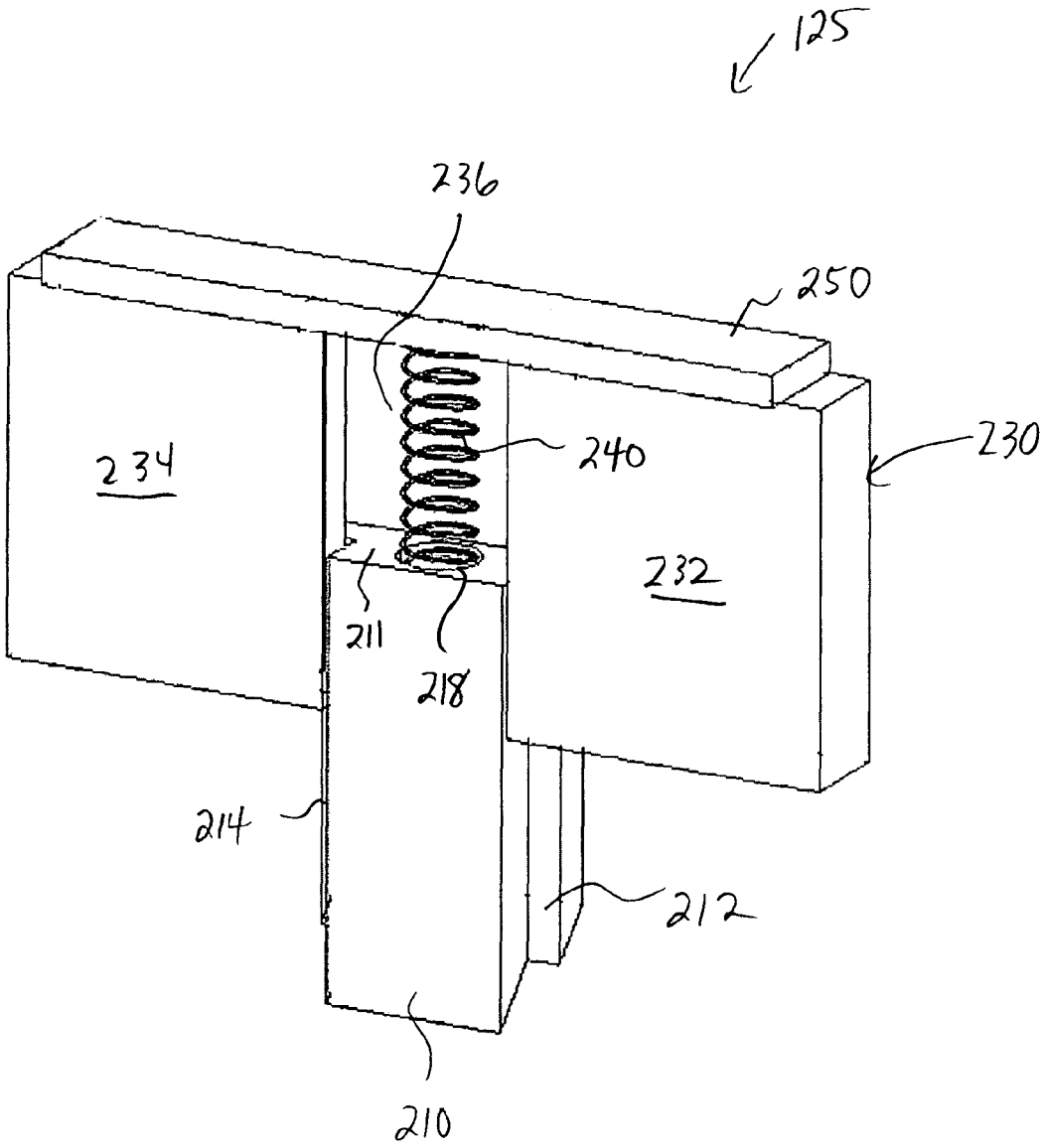
FIG. 2 is a front perspective view of an example embodiment of a mounting device, according to the present disclosure.
Figure 3:
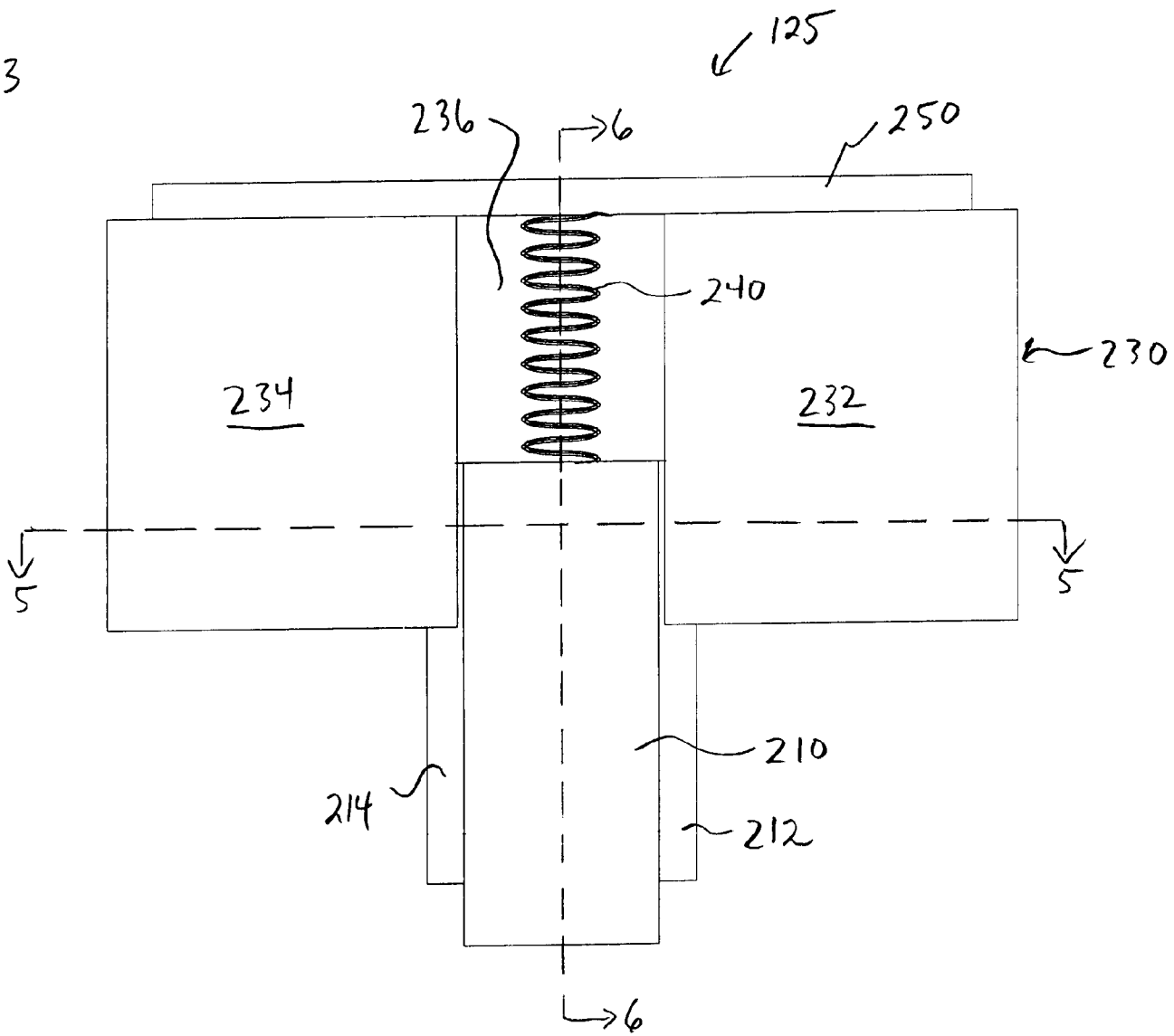
FIG. 3 is a front elevational view of the example mounting device of FIG. 2.
Figure 4:
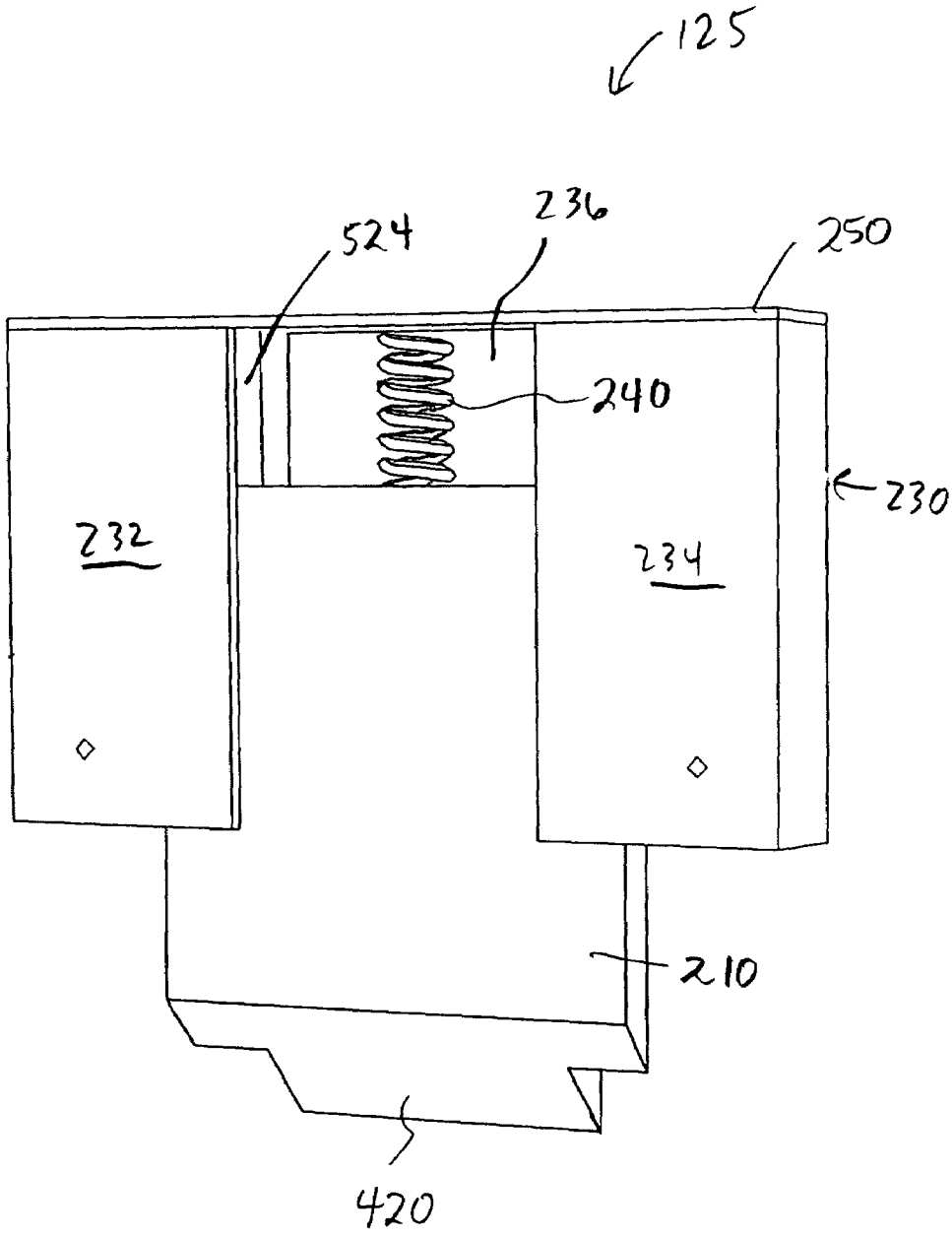
FIG. 4 is a back perspective view of the example mounting device of FIG. 2.
Figure 5:
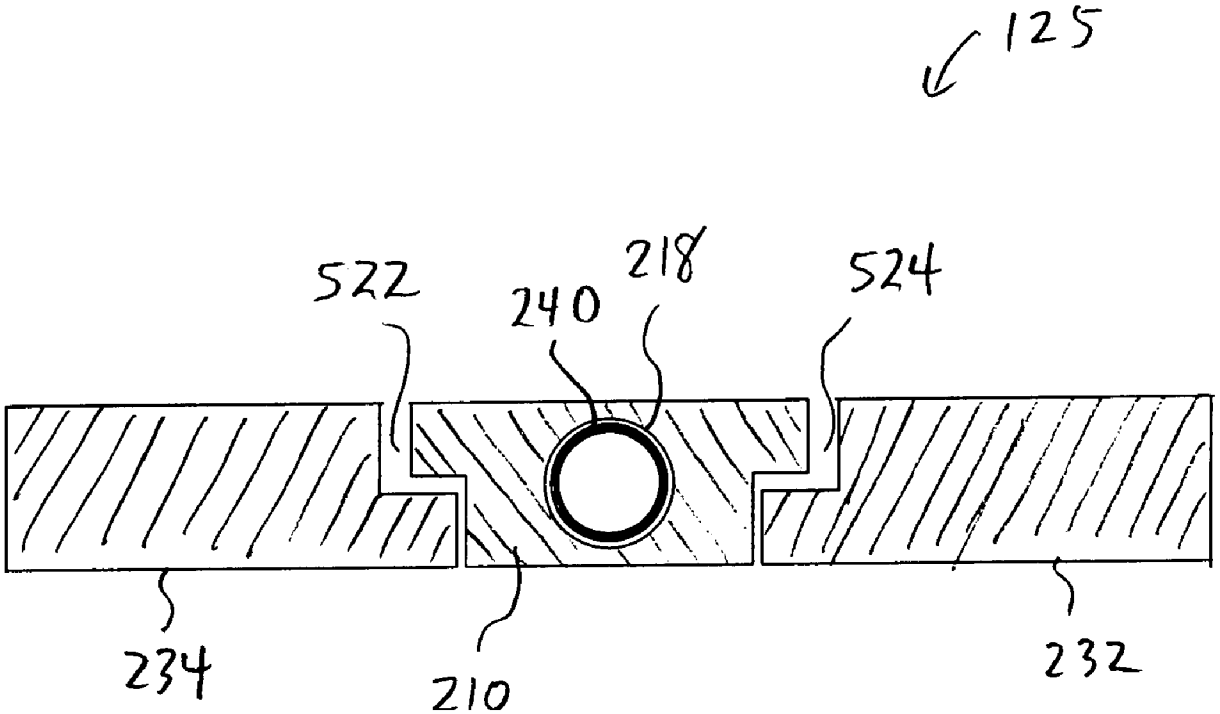
FIG. 5 is a cross-sectional view taken along line 5—5 of the example mounting device of FIG. 3.
Figure 6:
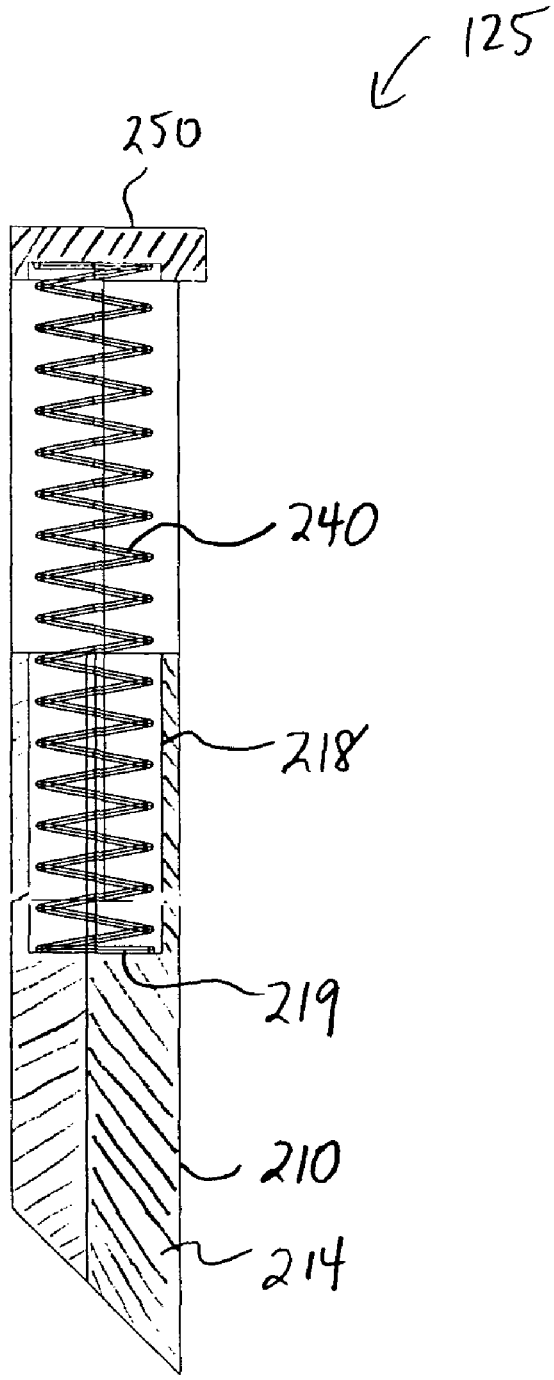
FIG. 6 is a cross-sectional view taken along line 6—6 of the example mounting device of FIG. 3.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

This invention relates to mounting devices. The invention also relates to assemblies and methods for mounting a fireplace mantel. While the invention is not so limited, a greater understanding will be achieved through review of the following description and attached drawings.

As used herein, the term "coupled" means any structure or method that may be used to connect two or more elements, which may or may not include a direct physical connection between the elements.

In general, the present disclosure is related to mounting assemblies and methods of installing the same. The mounting assembly can include one or more mounting devices and can be used in various types of apparatus that can be hung or mounted on a wall or the like. For example, preferred embodiments disclosed herein describe use of example mounting assemblies for mounting a fireplace mantel to a wall of a structure. However, the mounting assemblies disclosed herein are equally applicable for use with mounting of other objects such as, for example, cabinets, pictures, or shelves.

Referring now to FIG. 1, a back perspective view of a fireplace mantel 110 is shown incorporating an example embodiment of a mounting assembly 105 in accordance with the present invention. The mantel 110 includes a ledge 112, legs 114, and a connecting member 116 therebetween.

The example mounting assembly 105 includes a ledger strip 120 and two mounting devices 125 and 127. While the example embodiment shown includes two mounting devices, a single mounting device can be used, as can more than two mounting devices, depending on the particular mantel being installed.

Figure 7:
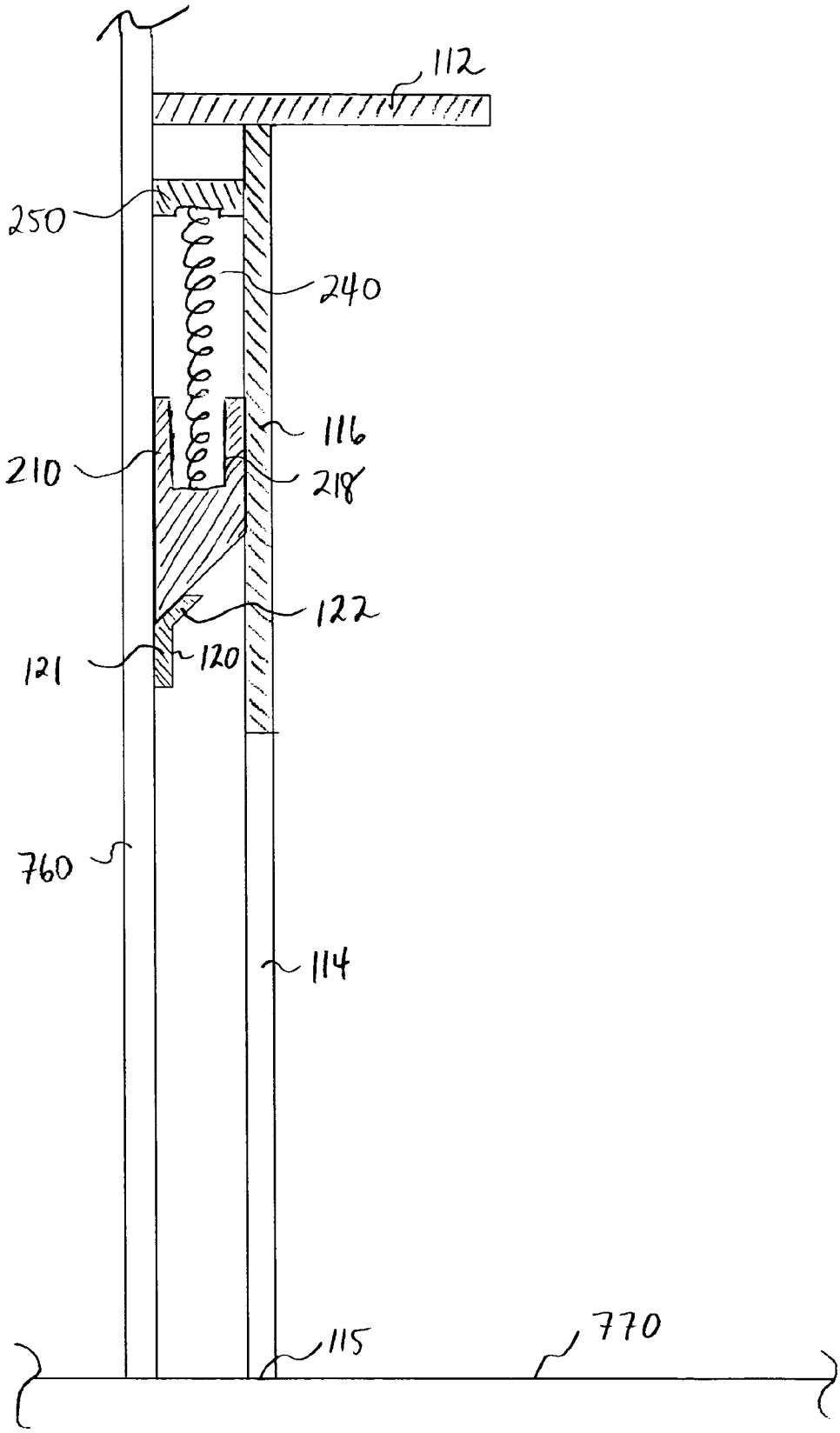
FIG. 7 is a side, partial cross-sectional view taken along line 7—7 of the example fireplace mantel and mounting assembly of FIG. 1.

The mounting devices 125 and 127 are coupled or secured to a back side 118 of the mantel 110 that will face a wall of the structure when the mantel is mounted (see, for example, FIG. 7). The mounting devices 125 and 127 can be manufactured separately from the mantel 110 and then installed at, for example, the job site during installation of the mantel. Alternatively, the mounting devices 125 and 127 can be made an integral part of the mantel 110 during manufacture of the mantel. Preferably, the mounting devices 125 and 127 are spaced symmetrically and equidistant across the width of the connecting member 116 of the mantel 110.

Referring now to FIGS. 2–6, each mounting device, such as mounting device 125, preferably includes a spring-loaded bevel-cut plunger 210 with side flanges 212 and 214 pinioned in two grooved (dadoed or rabbeted) side rails 522 and 524 and configured to slide in a space 236 formed by a main body 230. The main body 230 preferably is formed of right and left portions 232 and 234 between which the space 236 is defined.

This arrangement allows the plunger 210 to slideably translate substantially vertically along the long axis of the plunger 210 relative to the main body 230 within space 236. The flanges 212 and 214 of the plunger 110 ride within the side rails 522 and 524 as the plunger translates vertically. For example, if the rails 522 and 524 are rabbets, the plunger 110 can be pinioned between the rails 522 and 524 and the back surface 118 of the mantel (see FIG. 1).

A beveled end 420 of the plunger 210 is preferably formed in a configuration complementary to bevel 122 of the surface of the ledger strip 120 upon which the plunger 210 is seated (see FIG. 7). Other complementary shapes can also be used including, for example, flat or curved shapes. The complementary shape of the end 420 of the plunger 210 and the ledger strip 120 beveled surface 122 advantageously tends to pull the mantel 110 towards the wall (see FIG. 7) when the mounting devices 125 and 127 are coupled to the ledger strip 120.

Still referring to FIGS. 2–6, a biasing or compressible member such as a spring 240 is also provided on the mounting device 125. One end of the spring 240 is received by a cavity 218 formed by the plunger 210 and is preferably attached to a bottom 219 of the cavity (see FIG. 6). The other end of the spring 240 contacts, and is preferably attached to, a stop member 250.

The stop member 250 can be integral to the mounting device 125, or can alternatively be formed by a portion of the mantel 110 (e.g., ledge 112 ) that contacts the upper end of the spring 240 when the mounting device 125 is coupled to the mantel.

In the example embodiments shown, when the spring 240 is in an uncompressed position there is preferably approximately 1.5 inches of clearance between the upper end 211 of the plunger 210 and the stop member 250. This arrangement allows for fine positioning of the mantel 110 after it is roughed into place on the wall (see, e.g., FIG. 7).

For example, the length of the portion of the spring 240 not contained in the cavity 218 sets the amount of installation tolerance of the mounting device 125. In the example embodiment shown, the tolerance is 1.5 inches, which is sufficient for most installation conditions. One of skill in the art will recognize that this dimension can be varied to accommodate different tolerances for different objects and their mounting requirements.

The spring 240 of each mounting device 125 and 127 is preferably configured so that the combined strength of all springs in the mounting assembly 105 in a given instance at maximum possible compression is less than that of the weight of the mantel 110 but enough to maintain downward pressure of the plunger 210 on the ledger strip 120. While the strength of the springs 240 will vary depending on the weight of the mantel 110, in the example embodiment shown each spring preferably has compression strength of between 6 and 12 pounds.

One of skill in the art will recognize that the total strength of the springs is preferably less than the weight of the mantel; otherwise the mantel will not be able to compress the springs when the mantel is being installed. Preferably, the total strength of the springs is between 10 and 90 percent of the weight of the mantel and, if multiple mounting devices are used, preferably the spring of each device is of the same strength.

In a preferred embodiment, the mounting device 125 can be assembled as follows. In an embodiment in which the mounting device 125 is formed as an integral component of the mantel 110, portions 232 and 234 are coupled to the back 118 of the mantel 110, preferably by a fastener, for example, a screw or a nail. The portions can also be adhered to the mantel using, for example, a glue or paste. The plunger 210 is slideably coupled between the portions 232 and 234, with the flanges 212 and 214 of the plunger 210 preferably pinioned in the grooves (dadoes) of the portions 232 and 234, or when using rabbet cuts, pinioned between the rails 522 and 524 formed in portions 232 and 234 and the back face 118 of the mantel. One free end of the spring 240 is then located adjacent the stop member 250, and the other end is disposed in the cavity 218 of the plunger 210.

The main body, plunger, and stop member of the mounting devices of the present disclosure can be made from various materials, for example, wood, plastic, or metal. One of skill in the art will recognize that the materials selected depend on the environmental conditions in which the mounting device will be used, including whether it will be exposed to heat from the fireplace.

Referring now to FIGS. 1 and 7, a preferred method of installation using the example mounting assembly 105 is now described. The ledger strip 120 is first located on the wall 760 where the mantel will be installed. The strip 120 can be positioned horizontally and vertically as desired to, for example, center the strip over the fireplace at the desired height. A lower portion 121 of the ledger strip 120 is then affixed to the wall 760 using techniques well known to those of skill in the art, for example, gluing, nailing, or screwing. The ledger strip 122 can also be an integral part of the wall 760 where the mantel will be installed.

The mantel 110, having the mounting devices 125 and 127 already coupled thereto, is then lifted and placed against the wall 760, with the beveled end 420 of the plunger 210 of each device 125 and 127 located adjacent to the beveled surface 122 of the ledger strip 120. The mantel 110 is then lowered until the beveled end 420 of each plunger 210 rests on the bevel 122 of the ledger strip 120.

The mantel 110 is then allowed to move vertically downward (pressure can also be applied to move the mantel 110 downward), the weight if the mantel 110 compressing the springs 240, until a bottom 115 of the legs 114 of the mantel 110 are in contact with the floor 770 or other area upon which the mantel legs will rest.

The mantel 110 can then be adjusted to insure that it is properly leveled, if further leveling is required, and the springs 240 will allow the mantel 110 to substantially vertically upward or downward within the 1.5 inch window while still maintaining attachment of the mantel 110 to the wall 760. The mantel 110 can also be adjusted from side to side.

One of skill in the art will recognize, in the example embodiment illustrated, that the ledger strip can preferably be installed by eye, using only one measurement related to vertical height of the strip, and fall within the 1.5-inch tolerance window along its entire length.

There are several advantages associated with use of the mounting assembly described herein. One advantage is that no nails are needed to hold the mantel in place, making the installer's task quick and simple. However, one of skill in the art will recognize that the mantel can be further coupled to the wall by various methods, for example, by caulking the space between the floor and the bottom of the legs. Alternatively an adhesive can be placed on the rear face of the mantel leg that is in contact with the wall. Also, fasteners such as screws or nails can, but need not, also be used. One of skill in the art will recognize that there are many acceptable ways to further secure the mantel to the wall after it is properly mounted in place using the ledger strip and mounting devices. For example, for a mantel that does not include legs, the edge of the ledge contacting the wall can be coupled to the wall using a pressure sensitive adhesive.

Another advantage is that the installer need only make two measurements to install the mantel, neither of which needs to be exact. Preferably, the installer need only make one measurement. For example, the first measurement is to roughly center the ledger strip laterally over the fireplace area. In most instances, the ledger strip is shorter than the width of the mantel. The second measurement relates to getting the ledger attached at the proper height. For an experienced installer, only the height measurement may need to be made.

Because the spring loading of the plunger in the example embodiment shown creates a 1.5 inch tolerance window above or below which the mantel can be properly installed, the vertical height of the ledger strip is not required to be highly precise, and the strip need not be completely level horizontally. If the ledger strip is not optimally located, but still within the tolerance window, the mantel can still be properly attached.

The present invention should not be considered limited to the particular examples described above, but rather should be understood to cover all aspects of the invention as fairly set out in the attached claims. For example, the mounting assembly of the present disclosure can also be used in various other applications that require location of an object on a wall. For example, as noted previously, the mounting assembly of the present disclosure can be used in installing or mounting other objects such as cabinets, pictures, or shelves. Various modifications, equivalent processes, as well as numerous structures to which the present invention may be applicable will be readily apparent to those of skill in the art to which the present invention is directed upon review of the instant specification.

What is claimed is:

1. A mantel assembly for a fireplace, comprising: a mantel including a rear surface; first and second legs extending from the mantel; and a mounting device coupled to the rear surface of the mantel, the mounting device comprising: a main body defining a space; a plunger disposed within the space and configured to move within the space; and a biasing member coupled to and biasing the plunger.

2. The mantel assembly of claim 1, wherein the mounting device is a first device, and wherein the mantel assembly further comprises a second device coupled to the rear surface of the mantel.

3. The mounting assembly of claim 1, further comprising a strip configured to be mounted on a wall, wherein an outer end of the plunger is configured to engage the strip.

4. The mounting assembly of claim 1, wherein the biasing member is a spring.

5. The mounting assembly of claim 4, wherein the spring is positioned between the plunger and a stop member.

6. The mounting assembly of claim 1, wherein the plunger defines a cavity sized to receive a portion of the biasing member.

7. The mounting assembly of claim 1, wherein the plunger is configured to move in a substantially vertical direction.

8. A method for mounting an object to a wall of a structure, the method comprising: providing a mounting device coupled to the object, the mounting device including a main body defining a space, a plunger disposed within the space and configured to move within the space, and a biasing member coupled to and biasing the plunger; mounting a strip on the wall of the structure; and positioning the object against the wall so that the plunger engages the strip, wherein the object is a mantel.

9. The method of claim 8, wherein the step of positioning further comprises allowing legs of the mantel to contact a floor of the structure.

10. The method of claim 9, wherein the step of providing further comprises setting a tolerance of the mounting device such that the biasing member allows the legs of the mantel to contact the floor of the structure.

* * * * *